United States Patent [19]

Smith

[11] Patent Number: 4,496,817

[45] Date of Patent: Jan. 29, 1985

[54] AUTOMATIC FIRE DETECTION FOR A MICROWAVE OVEN

[75] Inventor: Peter H. Smith, Anchorage, Ky.

[73] Assignee: General Electric Company, Louisville, Ky.

[21] Appl. No.: 511,556

[22] Filed: Jul. 7, 1983

[51] Int. Cl.[3] ..... H05B 6/68

[52] U.S. Cl. ..... 219/10.55 M; 219/10.55 B; 219/10.55 R; 340/578; 340/579; 236/44 C

[58] Field of Search ..... 219/10.55 B, 10.55 R, 219/10.55 M, 10.55 E, 510, 494, 497; 340/577, 578, 579, 588, 589, 628, 629; 236/44 C; 426/234, 241, 243, 242; 99/325, DIG. 14

[56] References Cited

U.S. PATENT DOCUMENTS

| | | | |
|---|---|---|---|
| 3,839,616 | 10/1974 | Risman | 219/10.55 |
| 4,097,707 | 6/1978 | Kobayashi et al. | 219/10.55 B |
| 4,133,995 | 1/1979 | Buck | 219/10.55 M |
| 4,154,855 | 5/1979 | Buck | 426/243 |
| 4,162,381 | 7/1979 | Buck | 219/10.55 B |
| 4,166,137 | 8/1979 | Buck | 426/243 |
| 4,171,382 | 10/1979 | Buck | 426/243 |
| 4,221,949 | 9/1980 | Minakawa | 219/10.55 C |
| 4,281,022 | 7/1981 | Buck | 426/233 |
| 4,295,028 | 10/1981 | Tanabe | 219/10.55 B |
| 4,311,895 | 1/1982 | Tanabe | 219/10.55 B |
| 4,316,068 | 2/1982 | Tanabe | 219/10.55 B |
| 4,319,110 | 5/1982 | Tanabe et al. | 219/10.55 B |
| 4,331,855 | 5/1982 | Tanabe | 219/10.55 B |
| 4,335,379 | 5/1982 | Martin | 340/634 |

FOREIGN PATENT DOCUMENTS

| | | | |
|---|---|---|---|
| 31156 | 1/1981 | European Pat. Off. . | |
| 52-13150 | 2/1977 | Japan | 219/10.55 B |
| 53-64839 | 6/1978 | Japan | 219/10.55 B |

*Primary Examiner*—P. H. Leung

*Attorney, Agent, or Firm*—H. Neil Houser; Radford M. Reams

[57] ABSTRACT

A method and apparatus for anticipating the occurrence of a fire in the cooking cavity of a microwave oven. The oven is provided with a blower for continuously circulating outside air through the cooking cavity to carry away gases by food loads being heated therein. A sensor responsive to the concentration of gases in the circulating air monitors the gas concentration level and generates an output signal representative thereof. Sensor monitoring circuitry responsive to the sensor output signal is operative to determine the rate of change of the gas concentration level, and a detect a characteristic rate of change indicative of the load being heated closely approaching its combustion point. Upon detection of the characteristic rate of change, power to the oven is turned off and and indication is provided to the user that a combustion condition in the oven cavity is imminent.

7 Claims, 5 Drawing Figures

FIRE DETECTION
INPUT Vo
152
154
IS Vo < VR ?
NO
YES
158
ΔV = Vo-Vo'
160
Vo → Vo'
162
ΔVT = ΔVT + ΔV
164
INCREMENT
166
IS T > TP ?
NO
YES
168
T = 1
170
(dV/dT)A = ΔVT
172
ΔVT = 0
174
IS DRY OUT FLAG SET ?
YES
NO
176
IS (dV/dT)A < ΔS ?
YES
NO
178
SET DRY OUT FLAG
180
IS (dV/dT)A > ΔL ?
NO
YES
182
TURN OFF MAGNETRON AND BLOWER
184
TRIGGER ALARM
156
RETURN

AUTOMATIC FIRE DETECTION FOR A MICROWAVE OVEN

BACKGROUND OF THE INVENTION

The present invention relates generally to improvements in a microwave oven and more particularly to an arrangement for anticipating the occurrence of combustion in the cooking cavity of a microwave oven.

When heating a food load in a microwave oven, if the food load is allowed to heat substantially longer than required for proper cooking, the food itself or the container for the food may become heated to the combustion point, resulting in a fire in the oven cavity. The overcooking of whole potatoes, fats raised to the combustion temperature due to excessive overcooking of meats, and oven shelf hot spots due to imperfections in the pyroceramic shelf when heated over a prolonged period, are three primary sources of such cavity fires. The potato is particularly vulnerable to fire since it dries out non-linearly with the core of the potato getting hot before the outer portions. The heat from the core is not readily dissipated. As a result the core of the potato can be heated to its ignition point relatively quickly.

One commonly used approach to the cavity fire detection problem is to provide a thermal cutout switch on the oven cavity ceiling which cuts off the magnetron when the oven cavity ceiling temperature exceeds a predetermined level. This arrangement works satisfactorily but is relatively costly and has a relatively slow response time. An alternative approach is disclosed in U.S. Pat. No. 4,133,995 to Buck. In the Buck arrangement a humidity sensor and a temperature sensor are employed to monitor the relative humidity and temperature in the cavity. A microprocessor is programmed to detect a fire condition when both the temperature rises and the humidity falls by predetermined amounts within a prescribed time period, on the order of 10–30 seconds, and to de-energize the oven upon detecting such a condition.

The present invention improves over both of the foregoing approaches to fire detection in the microwave oven by providing an arrangement which anticipates fire conditions developing in the cooking cavity before actual ignition employing a single sensor normally used for cooking control which is responsive to the concentration of gases in the circulating air exiting the cooking cavity. In addition to providing an anticipatory warning of an imminent fire condition, this arrangement eliminates the need for the relatively costly thermal cutout switch and also eliminates the need for the "in situ" temperature sensor of the Buck method.

SUMMARY OF THE INVENTION

The present invention provides a method and apparatus for anticipating the occurrence of a fire in the cooking cavity of a microwave oven. The oven is provided with means for continuously circulating outside air through the cooking cavity to carry away gases emitted by food loads being heated therein. A sensor responsive to the concentration of gases in the circulating air monitors the gas concentration level and generates an output signal representative thereof. Sensor monitoring means responsive to the sensor output signal is operative to determine the rate of change of the gas concentration level, and detect a characteristic rate of change indicative of the load being heated closely approaching its combustion point. Upon detection of the characteristic rate of change, means responsive to the sensor monitoring means de-energizes the oven and provides an indication to the user that a combustion condition in the oven cavity is imminent.

In accordance with one form of the invention, tne sensor monitoring means detects the characteristic rate of change by first detecting a relatively slow rate of change indicative of the food load drying out and thereafter detecting a relatively rapid rate of change indicative of the load being heated to a temperature closely approaching its combustion temperature.

BRIEF DESCRIPTION OF THE DRAWINGS

While the novel features of the invention are set forth with particularity in the appended claims, the invention both as to organization and content will be better understood and appreciated from the following detailed description taken in conjunction with the drawings, in which:

DETAILED DESCRIPTION

Figure 1:
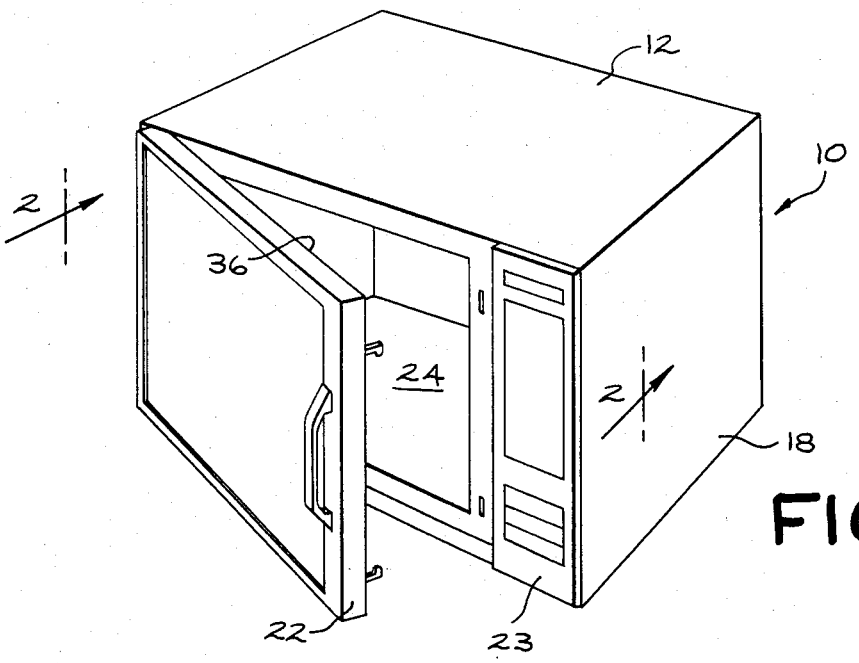
FIG. 1 is a perspective view of a microwave oven embodying the present invention.
Figure 2:
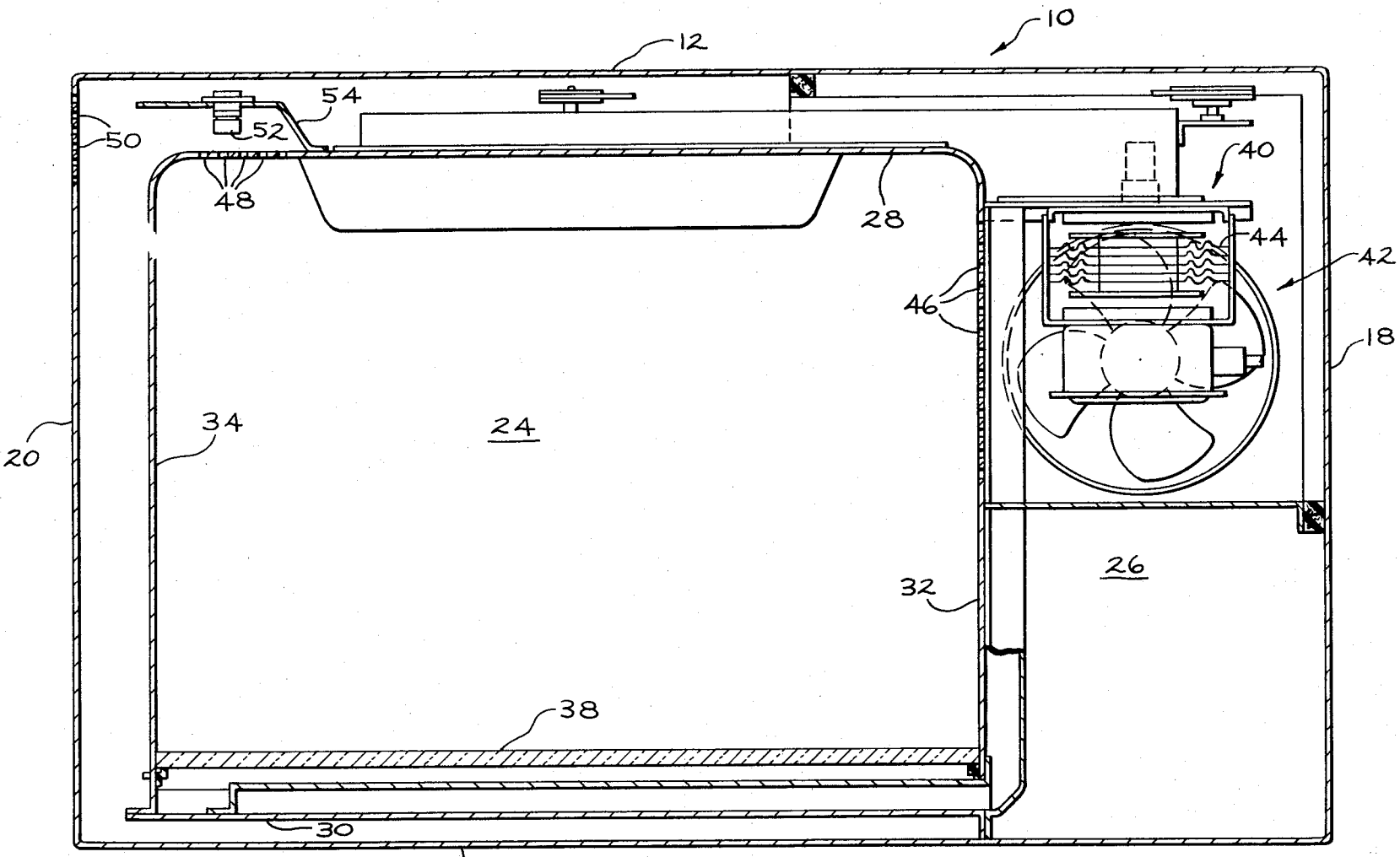
FIG. 2 is a schematic sectional view of the oven of FIG. 1 taken along lines 2—2.

Referring now to FIGS. 1 and 2, there is shown a microwave oven designated generally 10. The outer cabinet comprises six cabinet walls including upper and lower walls 12 and 14, a rear wall (not shown), two side walls 18 and 20, and a front wall partly formed by a hingedly supported door 22 and partly by control panel 23. The space inside the outer cabinet is divided generally into a cooking cavity 24 and a controls compartment 26. Cooking cavity 24 is formed by a top wall 28, a bottom wall 30, side walls 32 and 34, the rear cavity wall being a cabinet wall and the front cavity wall being defined by the inner face 36 of door 22. A shelf 38 of pyroceramic material or other suitable material pervious to microwave energy is provided in the lower region of cavity 24 to support food loads to be heated in cavity 24.

A magnetron 40 adapted to produce microwave energy is mounted in controls compartment 26. Means for circulating air through the cavity 24 includes a blower designated generally 42 which draws cooling air into the controls compartment 26 through louvered openings (not shown) formed in the back cabinet wall. This air passes over cooling fins 44 of magnetron 40. A portion of the air drawn in by blower 42 enters cavity 24 via perforations 46 formed in cavity side wall 32. This air circulates past the food load (not shown) being heated in cavity 24 and exits cavity 24 through perforations 48 formed in upper cavity wall 28 near the upper left corner of cavity 24. Vent holes 50 formed in side cabinet wall 20 near the upper left corner of the oven cabinet permit air exiting cavity 24 via perforations 48 to exit the oven cabinet to the exterior.

Foods heated in the microwave oven tend to emit water vapor and other gases as the food heats. Such gases mix with the air circulating in the cavity and are removed from the cavity by the circulating air. Means for sensing the concentration level of such gases in the air leaving the cavity is provided in the form of a gas sensor 52 disposed in the air flow path between perforations 48 in cavity wall 28 and vent openings 50 in cabinet wall 20. Sensor 52 is supported proximate perforations 48 by mounting bracket 54 which is suitably secured to cavity wall 28. Sensor 52 in the illustrative embodiment of FIG. 2 is a gas sensor readily commercially available from Figaro Engineering, Inc., identifiable as Model TGS No. 186. This sensor is responsive to the cumulative concentration of water vapor and various organic gases. Use of such a sensor in a microwave oven for automatic cooking control is known in the art. One example of such a control arrangement is described in U.S. Pat. No. 4,311,895.

In accordance with the present invention, information regarding the concentration level of gases in the circulating air exiting cavity 24 provided by sensor 52 is used to anticipate the occurrence of combustion conditions in the cavity.

It has been empirically determined that for foods likely to ignite in the oven cavity when overcooked, the concentration of gases emitted by the food load into the air circulating through the cavity changes during heating in a predictable fashion. At the beginning of the cooking cycle, the food load is normally not sufficiently heated to cause significant gaseous emissions from the food. Consequently, the sensed gas concentration level remains relatively low and constant. As the food continues to heat, it reaches sufficient temperature to begin emitting water vapor and organic gases. There ensues a period of relatively rapidly increasing gas concentration level which continues until the food load is heated to a point of near maximum gaseous emissions. The recommended cooking time for most foods is such that the cooking cycle is normally terminated prior to reaching this point. However, if the food continues to be heated beyond this point such as may inadvertently occur due to the miscalculation of appropriate cooking time or simply forgetfulness, the temperature of the food continues to rise but the gas concentration level increases relatively slowly during what can be a relatively long period, hereinafter referred to as the "drying out" period. Eventually, the temperature of the food closely approaches its combustion temperature. However, before actually reaching the ignition point, the food begins to char, smoke or smolder, resulting in a second period of relatively rapidly increasing gas concentration in the circulating air, comparable to that rate of increase which characterizes the normal cooking period. This second period of rapidly increasing concentration level, referred to hereinafter as the "pre-combustion" period, typically begins a matter of minutes before actual combustion in the cavity. Thus, detection of the transition from the drying out phase to the pre-combustion phase provides an advance warning that a combustion condition in the cavity is imminent. Hence, according to the present invention, a fire condition in the cavity of a microwave oven may be anticipated by monitoring the gas concentration level of the air circulated through the cavity during the cooking cycle, periodically determining the rate of change of the sensed concentration level during heating, and detecting a rate of change characteristic of the food load closely approaching its combustion temperature.

Figure 3:
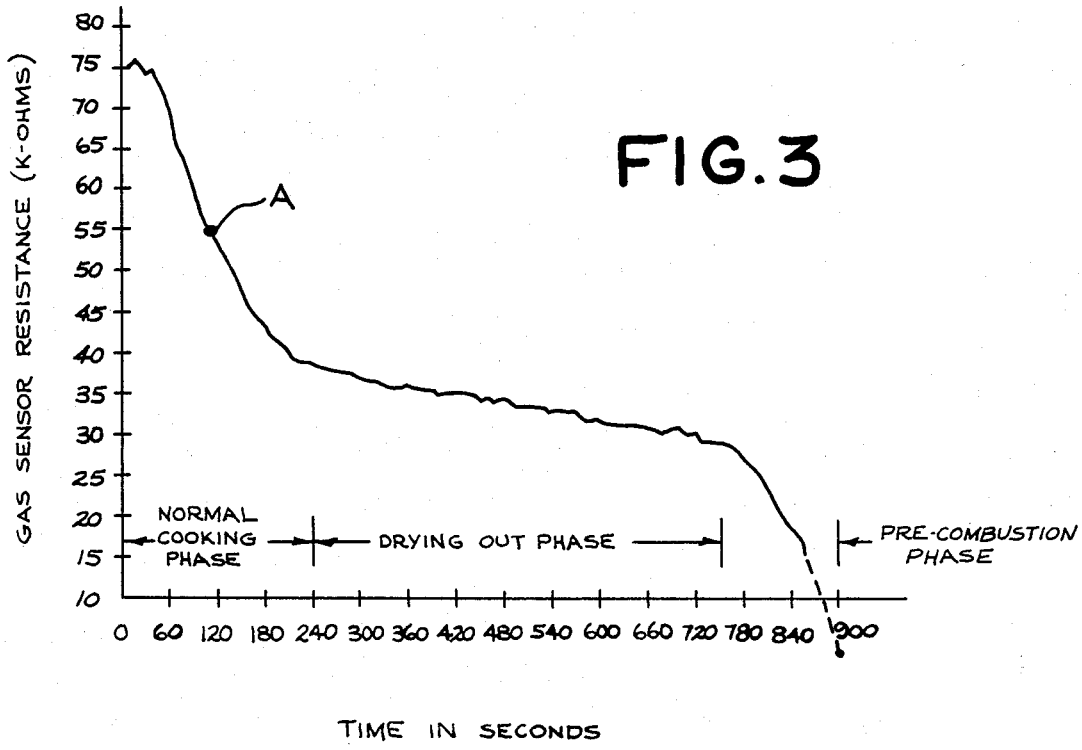
FIG. 3 depicts a curve representative of the gas emission characteristics of a baked potato heated in the microwave oven of FIG. 1.

The sensor resistance versus time curve of FIG. 3 shows the change in resistance of the sensing element of sensor 52 during the cooling cycle for a whole potato heated in cooking cavity 24 of oven 10 in response to the changing gas concentration level in the air exiting the cooking cavity as the potato is heated to its combustion point. The potato was chosen for purposes of illustration because, as described briefly in the Background discussion, it is one of the foods most easily overcooked to the point of combustion. Also, the basic shape of the response curve is fairly representative of all food loads of the type conducive to ignition when overcooked.

The resistance $R_s$ of the TGS 186 sensor varies with gas concentration level in the air to which it is exposed in accordance with the formula $$R_s = A \times C^{-\alpha}$$

where A and $\alpha$ are constants and C is the gas concentration. Hence, the changing resistance as the potato cooks reflects the aforementioned predictable variation in concentration level.

Referring particularly to FIG. 3, as the cooking cycle begins, the resistance is relatively high and constant indicative of the relatively low and essentially constant concentration level at this point. There next ensues a period in which the resistance decreases relatively rapidly indicative of the concentation level increase, characteristic of the normal cooking phase for the potato. The change from a relatively rapidly decreasing resistance to a relatively slowly decreasing resistance is indicative of the change from a relatively rapidly increasing concentration level to a period of relatively slowly increasing concentration level which marks the transition from the normal cooking phase to the drying out phase for the potato. Continued heating of the potato continues to raise its temperature but the resistance continues to decrease at a relatively slow rate indicating that during the relatively long drying out phase for the potato, which is roughly twice the duration of the normal cooking period, the gas concentration level is increasing at a relatively slow rate. As the temperature of the potato sufficiently closely approaches its combustion point, the resistance begins to decrease at a relatively rapid rate indicative of a relatively rapidly increasing gas concentration level. The transition from relatively slow to relatively rapid increase in concentration level marks the transition from the drying out phase to the pre-combustion phase. For a potato cooked in oven 10, this transition typically occurs at least 2–3 minutes prior to reaching the combustion temperature of the potato. Thus, by detecting the rate of change of the gas concentration level characteristic of the pre-combustion phase early in this phase, it is possible to anticipate a combustion condition in the cavity at least 2 to 3 minutes in advance. By turning off the power to the magnetron and blower at this point, fire in the cavity may be prevented.

Figure 4:
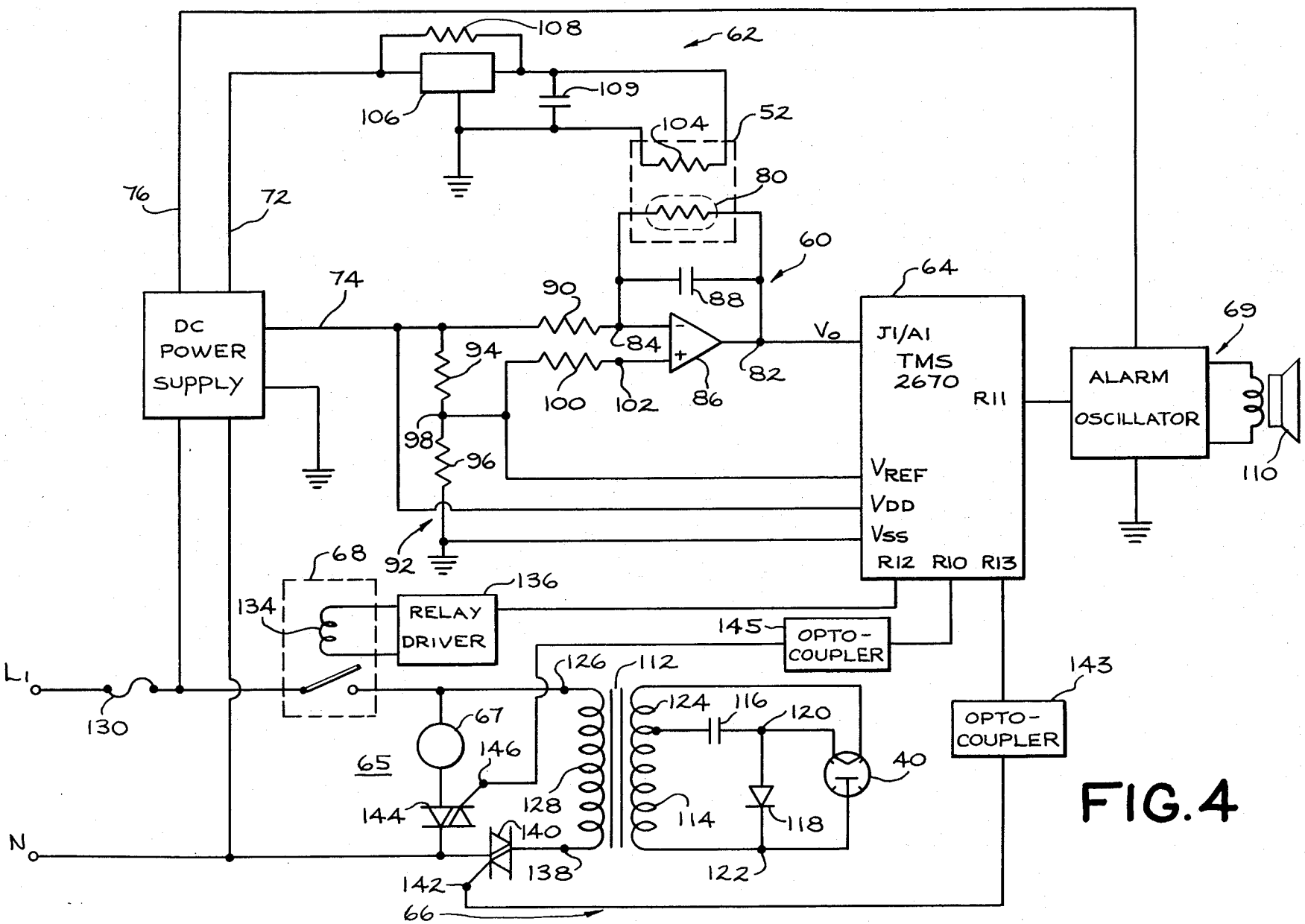
FIG. 4 is a simplified schematic circuit diagram of that portion of the microprocessor-based control system of the oven of FIG. 1 illustratively embodying the present invention.

Referring now to the simplified schematic circuit diagram of FIG. 4, gas sensor 52 is incorporated in a microprocessor based control arrangement which illustratively embodies the apparatus and performs the method of the present invention. The circuit of FIG. 4 includes a gas sensing circuit 60 for sensing the concentration level of gases in the circulating air as it exits cooking cavity 24, and generating a voltage signal having a magnitude representative of the sensed gas concentration level; a sensor heater circuit 62 for maintaining the sensing element of gas sensor 52 at its proper operating temperature; a microprocessor 64 for monitoring the voltage signal from sensing circuit 60; a power circuit 65 for oven 10 including a magnetron power circuit 66, an air circulating blower motor 67 and a power control relay 68 for controlling energization of magnetron power circuit 66 and air circulating blower 67 in response to a control signal from microprocessor 64; and an alarm circuit 69 responsive to a control signal from microprocessor 64 for providing an audible signal to the user of an imminent fire condition in the cooking cavity. Power for the circuit of FIG. 4 is provided by a conventional DC power supply circuit 70 which converts a standard 120 volt, 60 Hz AC signal input on lines L1 and N to dc output power signals of −9 volts, −9 volts and −16 volts on lines 72, 74, and 76, respectively.

Gas sensor circuit 60 includes a gas sensing element 80. Element 80 is the gas sensing element of sensor 52 (FIG. 2), which is exposed to the circulating air exiting cooking cavity 24. The resistance $R_s$ of sensor element 80 varies with gas concentration level in the circulating air exiting cavity 24 (FIG. 2) as hereinbefore described with reference to FIG. 3. Sensing element 80 is connected between the output terminal 82 and the inverting input terminal 84 of conventional operational amplifier 86. Capacitor 88 connected in parallel with sensor element 80 serves as a high pass filter for noise reduction. Input resistor 90 connects inverting input terminal 84 of amplifier 86 to DC supply line 74. Reference voltage divider 92 comprising resistors 94 and 96, serially connected between dc input line 74 and said system ground, provides the reference input signal for amplifier 86 at terminal 98. This signal is coupled to amplifier 80 by reference input resistor 100 connected between divider terminal 98 and the non-inverting input terminal 102 of amplifier 86.

The output voltage $V_o$ appearing at amplifier output terminal 82 is proportional to the ratio of the resistance of sensor element 80 to the resistance of input resistor 90. Hence, voltage $V_o$ varies linearly with the resistance of sensor element 80. Output terminal 82 of amplifier 86 is connected to input port J1/A1 of microprocessor 64 to couple the sensor output voltage $V_o$ to the microprocessor. As shown in FIG. 3, the approximate dynamic range for sensor element resistance $R_s$ of the illustrative embodiment during the cooking cycle is from 75K ohms at the beginning of the cooking cycle to less than 5K ohms at the combustion point. The magnitude of input resistor 90 and the magnitude of reference voltage from divider 92 are selected to scale and position the output voltage $V_o$ to fall within the desired input range for the internal analog to digital converter of microprocessor 64 over the dynamic range of sensor element 80.

TGS 186 gas sensor 52 includes heater element 104 as an integral component of the sensor package to maintain sensing element 80 at an appropriate temperature for satisfactory operation. For stable sensor operation, the voltage applied to sensor heater element 104 should be closely regulated. To this end, heater circuit 62 includes, in addition to sensor heater element 104, a voltage regulator integrated circuit 106. Heater element 104 is serially connected between the output of voltage regulator 106 and system ground. Voltage regulator 106 regulates the −9 volt dc signal from line 72 of power supply 70 to provide a regulated −5 volt signal to heater 104. Regulator circuit 106 in the circuit is a standard 7905 integrated circuit readily commercially available from National Semiconductor. Bypass resistor 108 connected in parallel with integrated circuit 106 and capacitor 109 in parallel with heater 98 reduce power dissipation in voltage regulator 106.

Sensor monitoring means responsive to the voltage signal $V_o$ generated by the sensor circuit 60 at terminal 82 is provided in the circuit of FIG. 4 by microprocessor 64 which is appropriately programmed to provide means for detecting a magnitude of $V_o$ indicative of a gas concentration level greater than a reference level, means for determining the rate of change of the magnitude of $V_o$, and means for first detecting a relatively small rate of change of magnitude indicative of the drying out phase for the food being heated following detection of concentration level greater than said reference level and thereafter detecting a relatively large rate of change of magnitude indicative of the transition to the pre-combustion phase. Microprocessor 64 is further programmed to generate a signal at output ports R11 and R12 upon detection of the large rate of change. The signal at R11 is operative to energize alarm oscillator circuit 69. Oscillator circuit 69 may comprise any one of a number of conventional multivibrator circuits known in the art to drive load speaker 110 at a frequency discernible by the user to indicate that a fire condition in cavity is imminent. The signal at R12 is operative to open power control relay 68, de-energizing power circuit 65, thereby de-energizing magnetron 40 and blower motor 67.

Microprocessor 64 is a standard TMS 2670 series 4K microprocessor of the type readily commercially available from Texas Instruments. The ROM of microprocessor 64 has been customized to perform the desired control functions for microwave oven 10.

Power circuit 65 is connected between power input lines L1 and N to provide power to magnetron 40 and blower motor 69 of blower 42 (FIG. 2). The power circuit 66 for magnetron 40 includes power transformer 112 having a high voltage secondary 114 connected to energize magnetron 40 through a half-wave voltage doubler comprising series capacitor 116 and rectifying diode 118 connected across the magnetron anode and cathode terminals 120 and 122, respectively, and oppositely poled with respect thereto. Secondary winding portion 124 of transformer 112 is connected as a filament winding to heat the cathode of magnetron 40. Power line L1 is coupled to terminal 126 of primary winding 128 of transformer 112 through a fuse 130 and main power relay switch 68. Main power relay 68 is controlled by a signal from microprocessor 64 coupled to the relay coil 134 of relay 68 from output port R12 via conventional relay driver circuit 136. The other terminal 138 of primary winding 128 is coupled to power line N via triac 140 having a gate terminal 142. Triac 140 is operated in a duty cycle control mode by suitable control signals from output port R13 of microprocessor 64 which are coupled to triac gate terminal 142 via conventional opto-coupler circuit 143.

Energization of fan motor 67 is controlled by triac 144 serially connected to motor 67 across power lines L1 and N. Triac 144 is controlled by signals from output port R10 of microprocessor 64 connected to triac gate terminal 146 of triac 144 via conventional opto-coupler 145.

The following component values have been found suitable for use in the circuit of FIG. 4. These values are exemplary only and are not intended to limit the scope of the claimed invention.

| | |
|---|---|
| FIXED RESISTORS | |
| 90 | 107K ohms |
| 94 | 732 ohms |
| 96 | 511 ohms |
| 100 | 22K ohms |
| 108 | 56 ohms |
| CAPACITORS | |
| 88 | .01 μf |
| 108 | 10 μf |
| 116 | .91 μf |

Operation of the circuit of FIG. 4 will now be described with reference to the flow diagram of FIG. 5. This flow diagram illustrates an algorithm which is implemented in the ROM of microprocessor 64. From this diagram, one of ordinary skill in the programming art can readily prepare a set of instructions for permanent storage in the ROM of microprocessor 64. It is of course to be understood that other portions of the microprocessor ROM may be utilized to implement additional oven control algorithms. Since the details of such additional algorithms add nothing to the understanding of the present invention such details have been omitted for brevity and simplicity.

Figure 5:
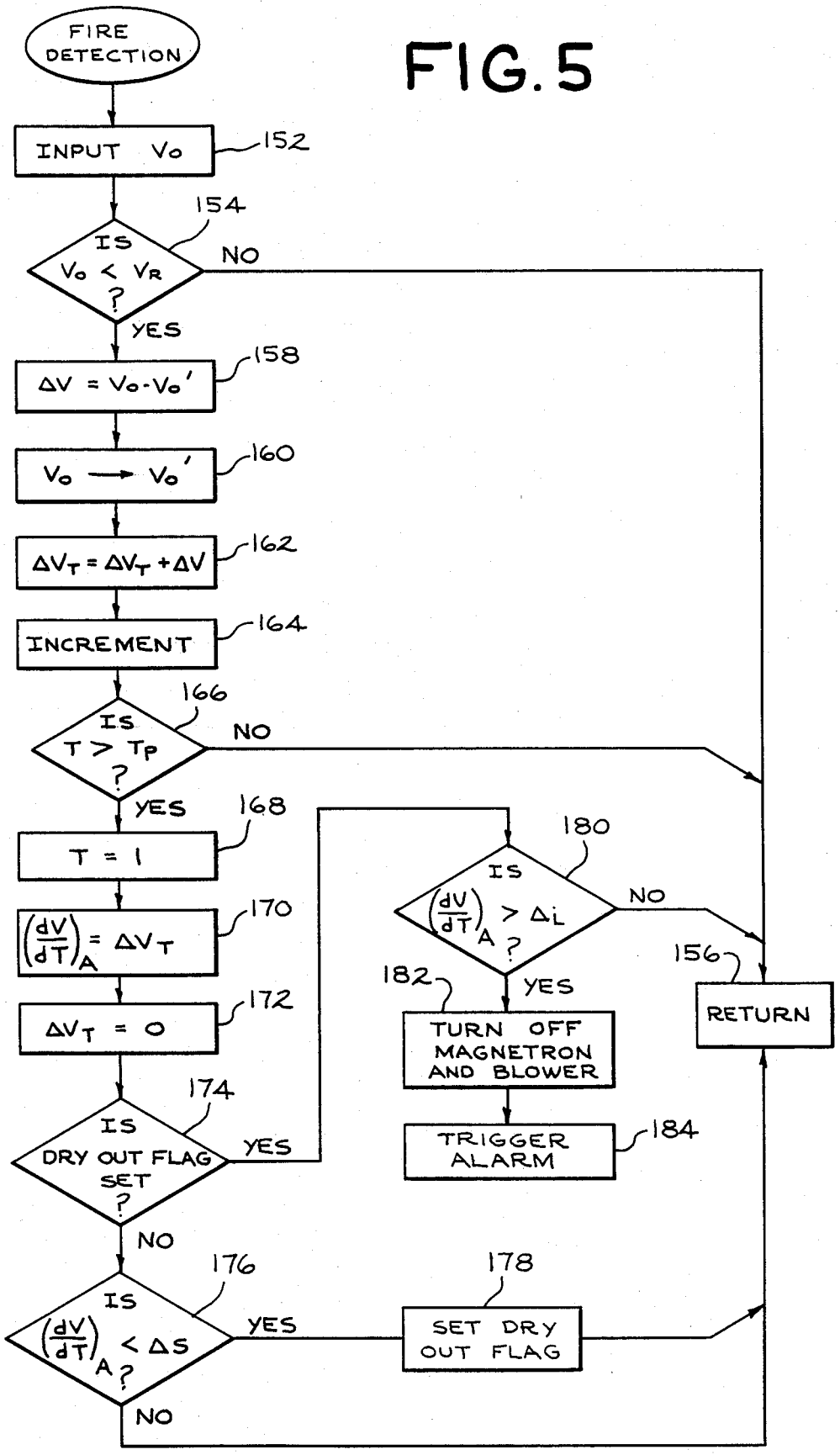
FIG. 5 is a flow diagram illustratively embodying a fire detection control algorithm implemented by the microprocessor in the circuit of FIG. 4 in accordance with the present invention.

The method of anticipating a fire condition in the cooking cavity implemented by the algorithm illustrated in the flow diagram of FIG. 5 includes the following steps. First, in order to distinguish the initial period of relatively constant gas concentration which normally occurs at the beginning of the normal cooking phase (FIG. 3), from the later occuring "drying out" phase, the sensor output voltage $V_o$ is monitored to detect a voltage magnitude corresponding to a concentration level indicative of having progressed in the cooking cycle to a point beyond the initial plateau. Having detected a concentration level in excess of the reference level, the rate of change of $V_o$ corresponding to the rate of change of sensed concentration level is periodically determined. The rate of change of voltage magnitude is then monitored, first to detect a rate of change corresponding to a rate of change of concentration level less than a predetermined rate signifying transition from the normal cooling phase to the drying out phase. Having detected such a lesser rate, the rate of change of $V_o$ is thereafter monitored to detect a rate of change corresponding to a rate of change of concentration level greater than a predetermined rate, signifying the transition from the drying out phase to the pre-combustion phase. Upon detection of the greater rate, the magnetron and the blower motor are de-energized and an indication is provided to the user such as an audible signal signifying that a combustion condition in the cavity is imminent.

Referring now to FIG. 5, the FIRE DETECTION routine is periodically entered from the master or executive program for microprocessor 64 throughout the cooking cycle. Such periodic entry may be satisfactorily made with a time between entries on the order of 2–5 seconds. However, time between entries need not be limited to this range for satisfactory performance. Upon entering the routine, the sensor output voltage $V_o$ at input port J1/A1 is sampled (Block 152). Inquiry 154 compares the sampled voltage $V_o$ with a predetermined reference value $V_R$ representative of the food being heated having reached that portion of the normal cooking phase characterized by a relatively rapidly increasing concentration level. In the illustrative example, a reference voltage level $V_R$ corresponding to the sensor resistance at point A (FIG. 3) was somewhat arbitrarily selected as being about the midpoint of this portion of the normal cooking phase for a potato. The precise reference value is not critical provided it represents a point between the initial constant portion of the normal cooking phase and the transition into the drying out phase. A No response to Inquiry 154 results in a return (Block 156) to the master program. As the food continues to heat, at some point prior to the end of the normal cooking phase the sensor output voltage $V_o$ will drop below the reference value $V_R$, resulting in a YES to Inquiry 154. On this and each subsequent pass through the FIRE DETECTION routine during the same cooking cycle, the response to Inquiry 154 will be Yes and Blocks 158–164 and Inquiry 166 will determine the rate of change of the magnitude of output voltage $V_o$. As shown by the resistance curve in FIG. 3, the change in resistance as the cooking cycle progresses is not a smooth curve but, rather, is characterized by irregular small oscillations. For proper operation the system must respond to the average rate of change computed over a sufficiently long period to smooth out the oscillations. The average rate of change is periodically determined as follows. First, the current incremental change $\Delta V$ in the output voltage $V_o$ is computed by subtracting $V_o$ from the previously sampled voltage signal stored as $V_o'$ (Block 158). $V_o$ is then placed in memory as $V_o'$ (Block 160). The cumulative or total change $\Delta V_T$ in voltage over the averaging period $T_P$ is updated by adding the just computed $\Delta V$ to the old $\Delta V_T$ (Block 162). Next, the timer T is incremented (Block 164). The duration of the averaging period is controlled by Inquiry 166 which detects T greater than $T_P$ where $T_P$ is the desired duration of the averaging period. The duration of the averaging period is not critical and may fall in a wide range of values provided only that it be of sufficient duration for adequate smoothing and yet sufficiently short to provide a satisfactory response time for the system. A period on the order of 30 seconds duration is thought to provide satisfactory smoothing. Until completion of the period $T_p$, a NO to Inquiry 166 causes a return (Block 156) to the main program. At the completion of each averaging period signified by a YES to Inquiry 166, the timer is reset (Block 168). The average rate of change $(dv/dt)_A$ for the just completed averaging period is set equal to the cumulative change for that period $\Delta V_T$ (Block170). This value is directly proportional to the true average since the time period $T_P$ is constant. $\Delta V_T$ is then reset for the next averaging period (Block 172). Having updated the average rate, Inquiry 174 checks the status of a Drying Out Flag, which is set upon detection of an average rate of change characteristic of the cooking operation having progressed to the drying out phase. Thus, initially, this Flag is not set and the response to Inquiry 174 is No. Inquiry 176 then compares $(dv/dt)_A$ with a predetermined reference $\Delta S$. $\Delta S$ corresponds to an average rate of change sufficiently small as to be characteristic of the cooking cycle having entered the drying out phase. Hence, Inquiry 176 detects the small rate of change characteristic of the drying out phase. During the balance of the normal cooking phase, the answer to Inquiry 176 is No and the program returns to the master program at this point (Block 156). As the food continues to be heated beyond the normal cooking phase, it enters its drying out phase. During this phase, as hereinbefore described, the rate of change of the concentration level drops off significantly. When a $(dv/dt)_A$ less than $\Delta S$ (Yes to Inquiry 176) is first detected indicative that the transition into the drying out phase has occurred, the Drying Out Flag is set (Block 178) and the program returns (Block 156). Thereafter, for the balance of the cooking cycle, Inquiry 174 indicates that the Drying Out Flag is set and the program will proceed to Inquiry 180 to detect a rate of change greater than a predetermined reference rate of change $\Delta L$ characteristic of entering the pre-combustion phase. For the balance of the drying out phase, Inquiry 180 will be No and the program will return to the master program at this point (Block 156). Upon detection of a rate of change greater than reference $\Delta L$, (Yes to Inquiry 180) a signal is provided at output port R12 causing power control relay 68 to open, thereby de-energizing magnetron 40 and the blower motor 67 (Block 182). It will be appreciated that fan motor 67 and magnetron 40 could alternatively be de-energized by inhibiting trigger signals to triac gate terminals 146 and 142, respectively, rather than by opening relay 68. The de-energizating of both the magnetron and the blower motor using either technique in effect turns off power to the oven. Also following a Yes to Inquiry 180, a signal is provided at R11 triggering the alarm oscillator circuit 69 into oscillation to provide an audible signal to the user that a fire condition in the cavity is imminent (Block 184).

By detecting the occurrence of a rapid increase in the rate of change of concentration level by the hereinbefore described method, magnetron 40 is de-energized prior to the load being heated in the oven reaching its actual combustion temperature, thereby anticipating a potential fire condition and preventing the load from reaching its combustion point.

While a specific embodiment of the method and apparatus of the present invention has been illustrated and described herein, it is realized that modifications and changes will occur to those skilled in the art to which the invention pertains. For example, to distinguish the drying out phase from the initial relatively constant portion of the normal cooking phase, rather than detecting a concentration level greater than a predetermined reference level to initiate looking for the relatively small rate of change marking the transition into the drying out phase, the reference level may be computed as a percentage of the initial value for each cycle. Alternatively, the elapsed time since initiation of the cooking cycle might be monitored to determine a starting point for detecting the small rate of change. It is therefore to be understood that the appended claims are intended to cover all such modifications and changes as fall within the true spirit and scope of the invention.

What is claimed is:

1. A method of anticipating a fire condition in the cooking cavity of a microwave oven of the type having means for continuously circulating air through the cavity to remove gaseous emissions from the food being heated in the cavity and sensor means for sensing the concentration of such gases in the circulating air, said method comprising the steps of:

circulating air through the cavity to remove therefrom gases emitted from the food load being heated in the cavity;

sensing the concentration level of such gases in the circulating air;

periodically determining the rate of change of concentration level;

monitoring the rate of change to detect a rate of change characteristic of the temperature of the food load in the cavity closely approaching its combustion temperature including the steps of detecting a first relatively slow rate of change indicative of the load having been cooked to its drying out stage and thereafter detecting a second relatively rapid rate of change, detection of said second rate following said first rate being indicative of closely approaching the combustion temperature of the load; and having detected said second rate of change, turning off power to the oven.

2. A method of anticipating a fire condition in the cooking cavity of a microwave oven of the type having means for continuously circulating air through the cavity to remove gaseous emissions from the food being heated in the cavity and sensor means for sensing the concentration of such gases in the circulating air, said method comprising the steps of:

continuously circulating air through the cooking cavity;

sensing the concentration level of gases emitted by the food in the circulating air;

detecting a concentration level above a predetermined reference level indicative of having heated the food sufficiently to cause the food to emit gases into the circulating air;

having detected a concentration level greater than the reference level, thereafter periodically determining the rate of change of the concentration level as a function of time;

monitoring the rate of change of the concentration level to detect a relatively small rate of change characteristic of the drying out of the food load;

having detected the small rate of change, thereafter monitoring the rate of change to detect a relatively large rate of change; and upon detection of the relatively large rate of change, turning off power to the oven and providing an indication to the user that a combustion condition in the oven is imminent.

3. A method of anticipating and preventing a fire condition in the cooking cavity of a microwave oven of the type having means for circulating air through the cavity and sensor means for sensing the concentration of gases in the circulating air emitted from food loads being heated in the cavity, said method comprising the steps of:

(a) continuously circulating air through the cooking cavity of the oven during the cooking cycle;

(b) periodically sensing the concentration level in the circulating air of gases emitted from the food during cooking and generating a voltage signal representative of the sensed concentration level;

(c) monitoring the voltage signal to detect a voltage level indicative of having completed an initial portion of the normal cooking cycle;

(d) having detected an indicative voltage, thereafter periodically computing the rate of change of voltage with time;

(e) monitoring the rate of change of voltage to detect a small rate of change of voltage characteristic of the drying out of the food load;

(f) having detected the small rate of change, thereafter monitoring the rate of change to detect a large rate of change characteristic of a relatively rapid increase in the concentration of gases in the circulating air; and (g) upon detection of the large rate turning off the power to the oven and providing an indication to the user that a combustion condition in the oven is imminent.

4. A method for anticipating the occurrence of a fire in the cooking cavity of a microwave oven of the type having means for circulating air through the cavity during the cooking process and a sensor for determining the concentration of gases in the circulating air emitted by foods being cooked in the cavity, which concentration level as a function of time is divided into three phases: a normal cooking phase characterized by an initial brief period of relatively constant concentration level followed by a period of relatively rapidly increasing concentration level; a drying out phase characterized by a relatively slowly increasing concentration level, and a pre-combustion phase, characterized by a relatively rapidly increasing concentration level, said method comprising the steps of:

circulating air through the cooking cavity of the oven;

detecting a concentration level of gases in the circulating air indicative of the cooking cycle having progressed beyond the initial period of the normal cooking phase for the food being heated;

thereafter periodically determining the rate of change of concentration level as a function of time;

detecting a first rate of change characteristic of the drying out phase;

having detected said first rate of change, thereafter detecting a second rate of change indicative of the pre-combustion phase; and upon detection of said second rate of change, turning off power to the oven and providing an indication to the user that a fire condition in the cavity is imminent.

5. A control arrangement for a microwave oven comprising:

means for generating microwave energy for heating foods received in the cooking cavity;

means for continuously circulating air through the cooking cavity to remove therefrom gases emitted by the food load being heated in the cavity;

sensing means for sensing the concentration level of such gases in the circulating air and generating a first signal having a magnitude representative of the sensed concentration level;

sensor monitoring means responsive to said first signal and including means operative to periodically determine the rate of change of concentration level as a function of time, and means operative to detect a rate of change indicative of closely approaching the combustion point of the load being heated in the oven, said detecting means including means for detecting the occurrence of the second of two periods of relatively rapidly increasing concentration level separated by a period of relatively slowly increasing concentration level, and generating a second signal upon detection of said second period; and means for terminating operation of said microwave energy generating means and said air circulating means in response to said second signal.

6. A control arrangement for a microwave oven comprising:

means for generating microwave energy for heating foods received in the cooking cavity;

means for continuously circulating air through the cooking cavity to remove therefrom gases emitted by the food load being heated in the cavity;

sensing means for sensing the concentration level of such gases in the circulating air and generating a first signal having a magnitude representative of the sensed concentration level;

sensor monitoring means responsive to said first signal and including means operative to periodically determine the rate of change of concentration level as a function of time, and means operative to detect a rate of change indicative of closely approaching the combustion point of the load being heated in the oven including means for detecting a relatively slow rate of increase in concentration level indicative of the food load being heated to its drying out stage and thereafter detecting a relatively rapid increase in concentration level indicative of closely approaching the combustion point of the food load and generating a second signal upon detection of said relatively rapid increase; and means for terminating operation of said microwave energy generating means and said air circulating means in response to said second signal.

7. A control arrangement for a microwave oven which anticipates a fire condition in the cooking cavity of the oven, said control arrangement comprising:

means for generating microwave energy for heating foods received in the cooking cavity;

means for continuously circulating air through the cooking cavity to remove therefrom gases emitted from the food load being heated in the cavity;

sensing means for sensing the gas concentration level of the circulating air and generating a first signal having a magnitude representative of the sensed gas concentration level;

sensor monitoring means responsive to said first signal including: means for detecting a signal magnitude indicative of a gas concentration level greater than a reference level; means for determining the rate of change of said signal magnitude; means for first detecting a relatively slow rate of change following detection of said concentration level greater than said reference level and thereafter detecting a relatively rapid rate of change;

means responsive to said sensor monitoring means operative to de-energize said microwave energy source and to terminate operation of said air circulating means following detection of said rapid rate of change; and means responsive to said sensor monitoring means operative to provide an indication to the user that a fire condition in the cavity is imminent following detection of said rapid rate of change.

* * * * *